US009995100B1

(12) United States Patent
Bogush

(10) Patent No.: US 9,995,100 B1
(45) Date of Patent: Jun. 12, 2018

(54) TAMPER-EVIDENT SEALING DEVICE FOR WELLS

(76) Inventor: Steven M Bogush, Selinsgrove, PA (US)

( * ) Notice: Subject to any disclaimer, the term of this patent is extended or adjusted under 35 U.S.C. 154(b) by 1028 days.

(21) Appl. No.: 13/355,091

(22) Filed: Jan. 20, 2012

Related U.S. Application Data

(60) Provisional application No. 61/435,841, filed on Jan. 25, 2011.

(51) Int. Cl.
*E21B 33/00* (2006.01)
*B65D 59/06* (2006.01)

(52) U.S. Cl.
CPC ..... *E21B 33/00* (2013.01); *B65D 59/06* (2013.01)

(58) Field of Classification Search
CPC ..... E21B 33/00; E21B 73/08; E21B 73/082; B65D 59/00; B65D 59/02; B65D 59/06; B65D 59/08
USPC ..... 138/96 R, 96 T; 166/227, 228
See application file for complete search history.

(56) References Cited

U.S. PATENT DOCUMENTS 2,371,913 A * 3/1945 Phillips et al. ..... 138/96 R
3,038,396 A * 6/1962 Jameson, Jr. et al. ..... 404/2
3,078,879 A * 2/1963 Mallard ..... 138/96 R
3,240,232 A * 3/1966 Matherne ..... B65D 59/00 138/96 T
3,666,095 A * 5/1972 Krynock ..... B07B 1/46 209/254
4,334,578 A * 6/1982 Labrum ..... B65D 55/14 166/75.13
4,411,312 A * 10/1983 English ..... E21B 33/03 166/75.13
4,715,439 A 12/1987 Fleming
4,757,595 A * 7/1988 Fraering, Jr. ..... B65D 59/00 138/96 T
4,766,033 A * 8/1988 Yoshimura et al. ..... 428/332
4,767,426 A * 8/1988 Daly et al. ..... 55/487
4,848,458 A 7/1989 Holdsworth et al.
4,905,764 A 3/1990 Laput
5,145,283 A * 9/1992 Gowen ..... B29C 47/0023 138/96 T
5,687,773 A * 11/1997 Ryan et al. ..... 138/96 R
6,502,632 B1 1/2003 Pittman
6,810,584 B2 * 11/2004 Kamei et al. ..... 29/869
(Continued)

OTHER PUBLICATIONS

Swistock, Bryan et al., "Sanitary Well Caps", Penn State College of Agricultural Sciences, Cooperative Extension.
(Continued)

*Primary Examiner* — J. Casimer Jacyna
(74) *Attorney, Agent, or Firm* — Wendy W. Koba

(57) ABSTRACT

A tamper-evident sealing device for use with a ground well (such as, for example, a water well, gas well, oil well, or the like) has been developed which takes the form of a UV-resistant, micro-perforated polymer plastic device that can be easily sealed over a well cap by applying heat. Should an unauthorized individual attempt to gain access to the well, he/she will necessarily have to break through the sealed, ventilated plastic layer, thus leaving behind indications of the tampering. In a preferred embodiment of the present invention, a conventional well cap as used in prior art well structures remains in place, with the plastic protective covering of the present invention sealed directly over the cap.

5 Claims, 1 Drawing Sheet

(56) References Cited

U.S. PATENT DOCUMENTS

| | | | | |
|---|---|---|---|---|
| 7,472,522 | B2 * | 1/2009 | Yang | 52/301 |
| 2003/0010726 | A1 * | 1/2003 | Zins | B01D 46/0028 210/767 |
| 2003/0019635 | A1 | 1/2003 | Acheson | |
| 2005/0011566 | A1 * | 1/2005 | Schritter | 138/96 R |
| 2007/0144600 | A1 * | 6/2007 | Moreau et al. | 138/89 |
| 2008/0142108 | A1 * | 6/2008 | Baker et al. | 138/96 R |
| 2010/0258301 | A1 * | 10/2010 | Bonner et al. | 166/230 |
| 2013/0213517 | A1 * | 8/2013 | Drouin | B65D 59/06 138/96 T |

OTHER PUBLICATIONS

Swistock, Bryan et al. "Protecting Wells with Sanitary Well Caps and Grouting", Penn State College of Agricultural Sciences, Cooperative Extension, 2006.

* cited by examiner

TAMPER-EVIDENT SEALING DEVICE FOR WELLS

CROSS-REFERENCE TO RELATED APPLICATIONS

This application claims the benefit of U.S. Provisional Application Ser. No. 61/435,841, filed Jan. 25, 2011 and herein incorporated by reference.

TECHNICAL FIELD

The present invention relates to a tamper-evident sealing device for use with a ground well (such as, for example, a water well, gas well, oil well, or the like) and, more particularly, to micro-perforated plastic device that can be easily sealed over a well cap (for example, by applying heat.)

BACKGROUND OF THE INVENTION

The closure of well casings extending above the surface of the ground is required by many governmental agencies and regulations. Customarily, the closure is intended to prevent undesirable matter from falling into or being deposited into the well. Such closures generally take the form of loose-fitting caps placed over the exposed top of the casing. The use of such a cap prevents some smaller animals from entering the well. The cap may be bolted onto the casing or, in some cases, locked in place to prevent tampering. FIGS. 1 and 2 illustrate a prior art well casing 1 and well cap 2, with FIG. 2 illustrating the particulars of well cap 2. In this prior art arrangement, the well cap is "tamper proof" by virtue of using a key 3 and lock 4 to attach cap 2 to casing 1 (with a plurality of screws 5 also used to hold cap 2 in place).

While such an arrangement does prevent the well cap from removed, if the key is lost or misplaced, the owner of the well may also experience difficulties or delays in accessing the well, such as when repairs or replacement of components is required.

Additionally, this type of well cap does not prevent small insects and other pests from entering the well (since the cap needs to be "loose fitting" to allow for continued ventilation). Another type of "vermin-proof" well cap has been developed that includes an airtight rubber gasket seal to prevent insects/pests from entering the well (while also including a small, screened vent to allow for air exchange). The "vermin-proof" well cap is not necessarily tamper-resistant. Moreover, many older well casings may not be able to utilize either the locking type of cap, the vermin-proof cap, or others of prior art caps that address these problems.

Thus, a need remains for a simpler arrangement for capping a well that is useful in preventing insects/pests from entering the well, while also providing evidence of any kind of attempt to tamper with the well, preferably remaining easy to use with existing well casing/cap arrangements.

SUMMARY OF THE INVENTION

The needs remaining in the prior art are addressed by the present invention, which relates to a tamper-evident sealing device for use with a ground well (such as, for example, a water well, gas well, oil well, or the like) and, more particularly, to a micro-perforated plastic device that can be easily sealed over a well cap. The device preferably comprises a "heat-shrink" plastic material that can be made to "form fit" over a well casing and cap by applying heat. Should an unauthorized individual attempt to gain access to the well, he/she will necessarily have to break through the sealed, ventilated plastic layer, thus leaving behind indications of the tampering.

In accordance with the present invention, the plastic sealing device comprises a plurality of micro-perforations (on the order of, for example, 6-10 one-thousandths of an inch in diameter) that allow for the necessary air exchange (ventilation) between the well and the outside environment without being large enough to let bugs and pests gain entry. Other sizes of perforations may be suitable for various embodiments of the present invention. The use of "micro" perforations are considered small enough to prevent vermin from gaining access to the well, while providing the air exchange capability. Preferably, the plastic is also UV-resistant, since it will be exposed to the environment.

In a preferred embodiment of the present invention, a conventional well cap as used in prior art well structures remains in place, with the plastic protective sealant of the present invention sealed directly over the cap. Alternatively, the plastic protective sealant of the present invention may be placed over the exposed top of the casing itself.

In yet another embodiment of the present invention, information regarding the well company, or other company associated with providing the sealing, may be imprinted on the plastic covering. If an untoward individual attempts to access the well, he/she would need to break the plastic, thus leaving behind evidence of the tampering.

In one specific embodiment, the present invention comprises a tamper-evident sealing device for a well including a sheet of plastic material with micro-perforations of a size sufficient to provide ventilation, the sheet of plastic being affixed to a well casing and preventing vermin from entering the well, while maintaining ventilation between the well and the outside environment and providing direct evidence of any attempt of tampering with the well.

Other and further aspects and benefits of the present invention will become apparent during the course of the following discussion and by reference to the accompanying drawings.

BRIEF DESCRIPTION OF THE DRAWINGS

Referring now to the drawings.

DETAILED DESCRIPTION

The present invention relates to a tamper-evident sealing device for a well (such as a water well, gas well, oil well, or the like) and, more particularly, to a micro-perforated plastic that can be easily sealed over a well cap. Preferably, the device is formed of a heat-shrink plastic that can easily be form-fit to the well casing and cap by the application of heat. Other types of affixing/attachment of the sealing device to the well may be used, such as directly bonding or taping the plastic to the casing. The sealing device of the present invention may be used with any existing well cap/casing configuration. Should an unauthorized individual attempt to gain access to the well, he/she will necessarily have to break through the sealed, ventilated plastic layer, thus leaving behind indications of the tampering. Thus, when seeing the plastic in place, an individual will be discouraged from attempting to access the well.

As mentioned above, in a preferred embodiment of the present invention, a conventional well cap as used in prior art well structures remains in place, with the plastic protective covering of the present invention sealed directly over the cap. Alternatively, the plastic protective covering of the present invention may be placed over the exposed top of the casing itself. In any of the these variations, the plastic material forming the sealing device may be imprinted with information regarding the company providing/installing the sealing device, so that if it is later found out that the seal has been broken, the proper authorities can be contacted.

Figure 1:
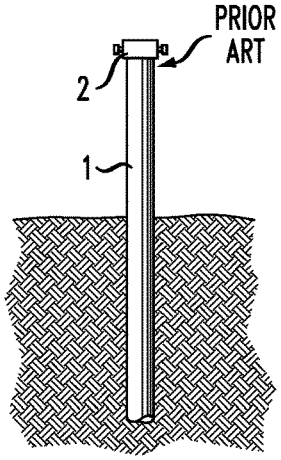
FIG. 1 is a prior art illustration of a portion of a well casing and associated well cap.
Figure 2:
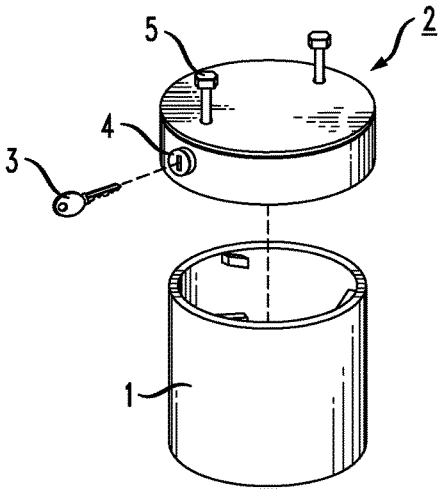
FIG. 2 PRIOR ART
FIG. 2 is an illustration of the particular components of a prior art well cap.
Figure 3:
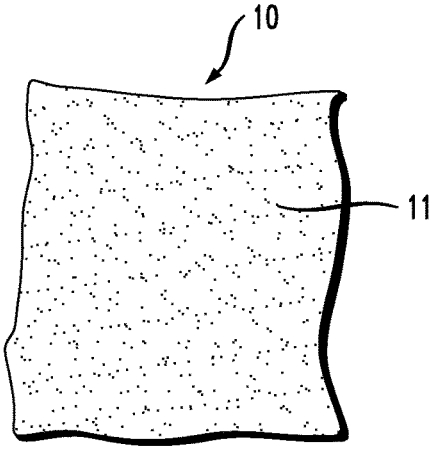
FIG. 3 is an exemplary sheet of micro-perforated plastic sheeting material for use in accordance with the present invention.

FIG. 3 illustrates a sheet of micro-perforated plastic 10 (with the micro-perforations 11 enlarged for the sake of illustration) that may be used to form a tamper-evident, vented well sealing device 12 in accordance with the present invention. The presence of micro-perforations 11 allows for the necessary air exchange between the well and the outside environment. Materials such as, for example, polyvinyl chloride (PVC) or polyolefin have been found suitable for this purpose, where they provide good sealing while preventing insects, rodents, and the like from gnawing through the plastic and entering the well. Micro-perforations on the order of 6-10 one-thousandths of an inch in diameter may be used, which have been found to provide the desired degree of air exchange, while maintaining the structural and strength integrity of the plastic sheeting. It is to be understood that various other plastic materials and perforation diameters may be used, as long as the perforations are large enough to provide the necessary gas exchange between the well and the environment and the plastic is strong enough to withstand vermin encroachment and environmental changes.

Figure 4:
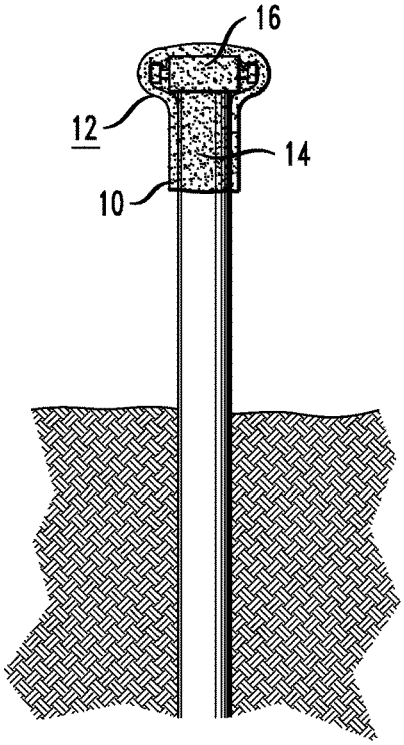
FIG. 4 illustrates a tamper-evident sealing device, as in place over a well cap, in accordance with the present invention.

FIG. 4 illustrates sealing device as disposed over an existing prior art well casing 14 and cap 16. The plastic 10 may be 'clear' or any color. For additional security, a serial number may be imprinted on plastic 10. As mentioned above, this is a preferred embodiment, where sealing device 12 is located over the combination of casing 14 and cap 16. It is also possible, however, to install sealing device 12 over the end termination of casing 14, and then install cap 16 in a conventional fashion.

Indeed, sealing device 12 is easily installed by a home owner or well drilling professional. Plastic sheet 10 is merely placed over well cap 16 and, in a preferred arrangement, heat is applied to "heat shrink" plastic 10 in place around casing 14 and cap 16 as shown in FIG. 4. The heating process will not disturb micro-perforations 11. Sealing device 12 thus "form fits" to well casing 14 and well cap 16, providing a protective barrier and preventing insects or other pests from entering the well. Any tear or rip in sealing device 12 is thus an obvious sign of tampering. Again, as mentioned above, in an alternative embodiment, sealing device may be "form fit" to casing 14, with well cap 16 thereafter installed over the sealed casing.

While the use of a "heat-shrink" material is preferred, other types of plastic sheeting may be used and otherwise affixed in place to cover casing 14 and cap 16 (for example, glued or taped in place). The present invention is considered to disclose any type of arrangement for affixing sealing device to a well cap and casing.

Sealing device 12 may be used with virtually any well—water, oil, gas, or any one of several types of monitoring wells used in environmental applications. Preferably, sealing device 12 is formed of a UV-resistant heat-shrink plastic, such as any type of polyvinylchloride (PVC) heat shrinkable tubing material or polyolefin heat shrinkable tubing material, since it will be exposed to the environment. These material choices are considered to be exemplary only, and various types of plastics may be used to form the sealing device of the present invention. By virtue of using a micro-perforated plastic in accordance with the present invention, the necessary ventilation for the well is maintained while deterring unauthorized individuals from attempting to access the well.

While the present invention has been described above in accordance with preferred embodiments, it is to be understood that there may be minor variations to the details of the sealing device of the present invention that would be apparent to those of skill in the art. Thus, it is asserted that the spirit and scope of the present invention is only limited by the claims appended hereto.

What is claimed is:

1. A tamper-evident sealing device for a ground well, the ground well including a well casing having an above-ground termination, the device comprising:

a well cap adapted to be coupled to an above-ground termination of a well casing; and a sheet of heat-shrink plastic material including micro-perforations of a size sufficient to provide ventilation, the sheet of heat-shrink plastic material for being sealed, using a heat process, over the end termination of the well casing in proximity to the well cap so as to prevent vermin from entering the well, the heat-shrink seal providing a deterrent to tampering and the micro-perforations maintaining ventilation between the well and the outside environment.

2. A tamper-evident sealing device as defined in claim 1 wherein the sheet of heat-shrink plastic material is sized to properly cover a combination of the end termination of the well casing and the well cap.

3. A tamper-evident sealing device as defined in claim 1 wherein the sheet of heat-shrink plastic material is further imprinted with identification information.

4. A tamper-evident sealing device as defined in claim/ wherein the identification information includes information regarding the installer of the sealing device.

5. A tamper-evident sealing device as defined in claim 1 wherein the sheet of heat-shrink plastic material is UV-resistant.

* * * * *